United States Patent [19]

Chandhoke

[11] Patent Number: 5,007,624

[45] Date of Patent: Apr. 16, 1991

[54] SHEET MATERIAL HANDLING APPARATUS AND METHOD

[75] Inventor: Mohanjit S. Chandhoke, Clinton, N.Y.

[73] Assignee: AM International Incorporated, Chicago, Ill.

[21] Appl. No.: 357,054

[22] Filed: May 25, 1989

[51] Int. Cl.[5] ..... B65H 39/00

[52] U.S. Cl. ..... 270/52; 270/57; 271/204

[58] Field of Search ..... 270/52, 54, 55, 57, 270/58; 271/204, 221, 226; 198/418, 434, 448

[56] References Cited

U.S. PATENT DOCUMENTS

| | | | |
|---|---|---|---|
| 3,758,365 | 9/1973 | Schilling . | |
| 3,809,214 | 5/1974 | Reist | 271/204 |
| 4,565,130 | 1/1986 | Leu | 270/58 |
| 4,606,173 | 8/1986 | Meier | 271/204 |
| 4,684,116 | 8/1987 | Hansch . | |
| 4,917,369 | 4/1990 | Moll | 270/58 |

FOREIGN PATENT DOCUMENTS

| | | | |
|---|---|---|---|
| 155633 | 9/1985 | European Pat. Off. | 270/58 |

*Primary Examiner*—Edward K. Look
*Assistant Examiner*—Therese M. Newholm
*Attorney, Agent, or Firm*—Tarolli, Sundheim & Covell

[57] ABSTRACT

A first series of sheet material articles, conveyed by a first gripper conveyor, is interleaved with a second series of sheet material articles, conveyed by a second conveyor, to enable the first and second series of articles to be delivered to a single receiving location in an interleaved relationship. To form the first series of sheet material articles, a plurality of collating spaces are sequentially moved past a first group of hoppers. To form the second series of sheet material articles, the plurality of collating spaces are sequentially moved past a second group of hoppers. Grippers of the first gripper conveyor sequentially grip the articles of the first series of articles at a first delivery location while grippers of a second conveyor are sequentially gripping articles of the second series of articles at a second delivery location. The paths of the two gripper conveyors converge and the first series of articles is interleaved with the second series of articles. The two series of interleaved articles are then conveyed, to a single receiving location where the articles are sequentially released in an interleaved relationship.

60 Claims, 6 Drawing Sheets

SHEET MATERIAL HANDLING APPARATUS AND METHOD

BACKGROUND OF THE INVENTION

The present invention relates to a new and improved sheet material handling apparatus and method wherein sheet material articles are conveyed by a pair of conveyors. The invention may advantageously be used in association with a collating conveyor assembly which forms sheet material assemblages. As used herein, the term sheet material article refers to one or more sheets of material while the term sheet material assemblage refers to a plurality of sheets of material.

It has previously been suggested that a single gripper conveyor assembly could be used to convey sheet material assemblages from a collating conveyor to a receiving location. The collating conveyor has a single delivery station at which sheet material assemblages are sequentially engaged by grippers of the gripper conveyor assembly. The gripper conveyor assembly moves the sheet material assemblages from the delivery location to a receiving location where the grippers are opened to deposit the assemblages on a receiving conveyor. One example of such an apparatus is disclosed in U.S. Pat. No. 4,721,296 issued Jan. 26, 1988 and entitled "Sheet Material Handling Apparatus".

The collating conveyor disclosed in the aforementioned U.S. patent has a single delivery station. However, collating conveyors having a plurality of delivery stations are disclosed in U.S. Pat. No. 3,881,716 issued May 6, 1975 and entitled "Combined Newspaper Press and Stuffer, and Method of Forming Newspapers Therewith"; U.S. Pat. No. 4,034,974 issued July 12, 1977 and entitled "Collating System"; and U.S. Pat. No. 4,477,067 issued Oct. 16, 1984 and entitled "Method and Apparatus for Assembling Sheet Material Assemblages". Sheet material assemblages from the two delivery locations in these collating conveyors are transported to two receiving locations. Thus, a first series of assemblages from a first delivery location is transported to a first receiving location by a first conveyor and a second series of assemblages is transported to a second receiving location by a second conveyor. The provision of two separate receiving locations results in a duplication of apparatus and personnel at the two receiving locations.

BRIEF SUMMARY OF THE INVENTION

The present invention provides a new and improved method and apparatus to interleave a first series of articles with a second series of articles. The first and second series of articles may be interleaved while the first series of articles is being conveyed by a first conveyor and the second series of articles is being conveyed by a second conveyor. By conveying both series of articles in an interleaved relationship to a single receiving location, duplication of equipment and personnel effort at the receiving location is minimized.

In one embodiment of the invention, a collating conveyor assembly forms two separate series of sheet material assemblages. A first series of sheet material assemblages is delivered to a first delivery location by the collating conveyor assembly. A second series of assemblages is delivered to a second delivery location by the collating conveyor assembly. First and second gripper conveyor assemblies engage the first and second series of assemblages at the delivery locations and transport them away from the collating conveyor assembly. The gripper conveyor assemblies release the sheet material assemblages in an interleaved relationship at a receiving location.

Accordingly, it is an object of this invention to provide a new and improved method and apparatus wherein a first series of articles is conveyed by a first conveyor in an interleaved relationship with a second series of articles being conveyed by a second conveyor.

Another object of this invention is to provide a new and improved method and apparatus for forming a first series of sheet material articles and conveying them to a receiving location and for forming a second series of sheet material articles and conveying them to the same receiving location, the sheet material articles being released at the receiving location in an interleaved relationship.

BRIEF DESCRIPTION OF THE DRAWINGS

The foregoing and other objects and features of the present invention will become more apparent upon a consideration of the following description taken in connection with the accompanying drawings, wherein.

DESCRIPTION OF PREFERRED EMBODIMENTS OF THE INVENTION

General Description

Figure 1:
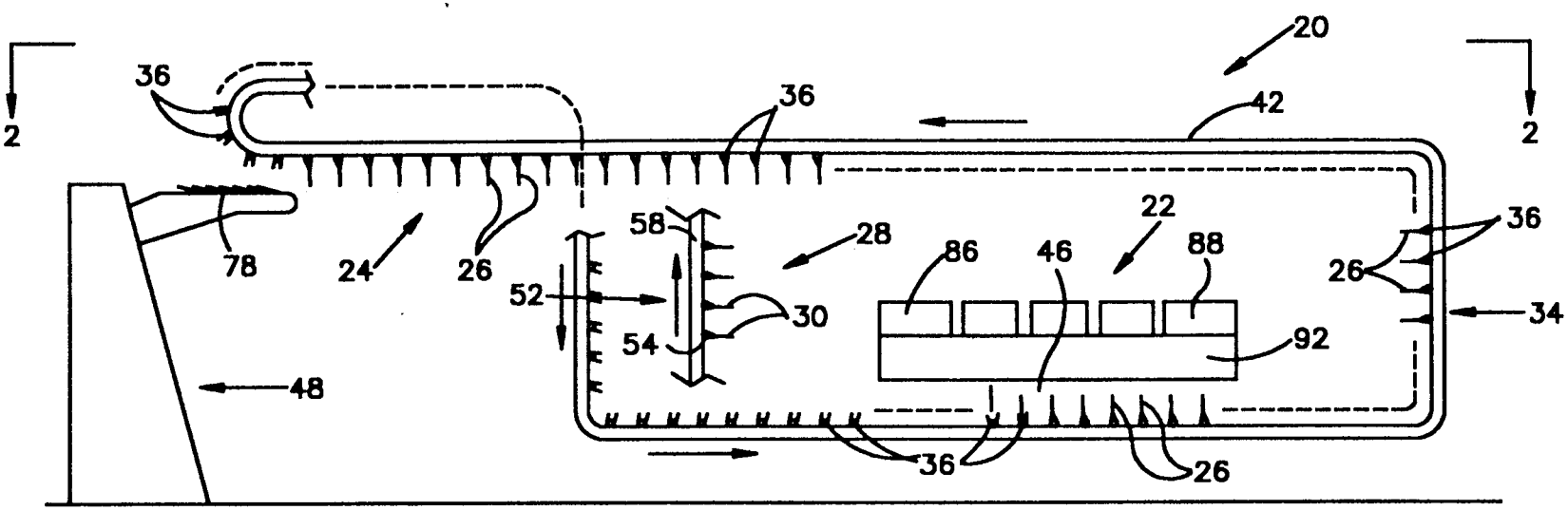
FIG. 1 is a schematic elevational view illustrating the relationship between a collating conveyor assembly which forms first and second series of sheet material assemblages and first and second gripper conveyor assemblies which convey the sheet material assemblages to a single receiving location.
Figure 2:
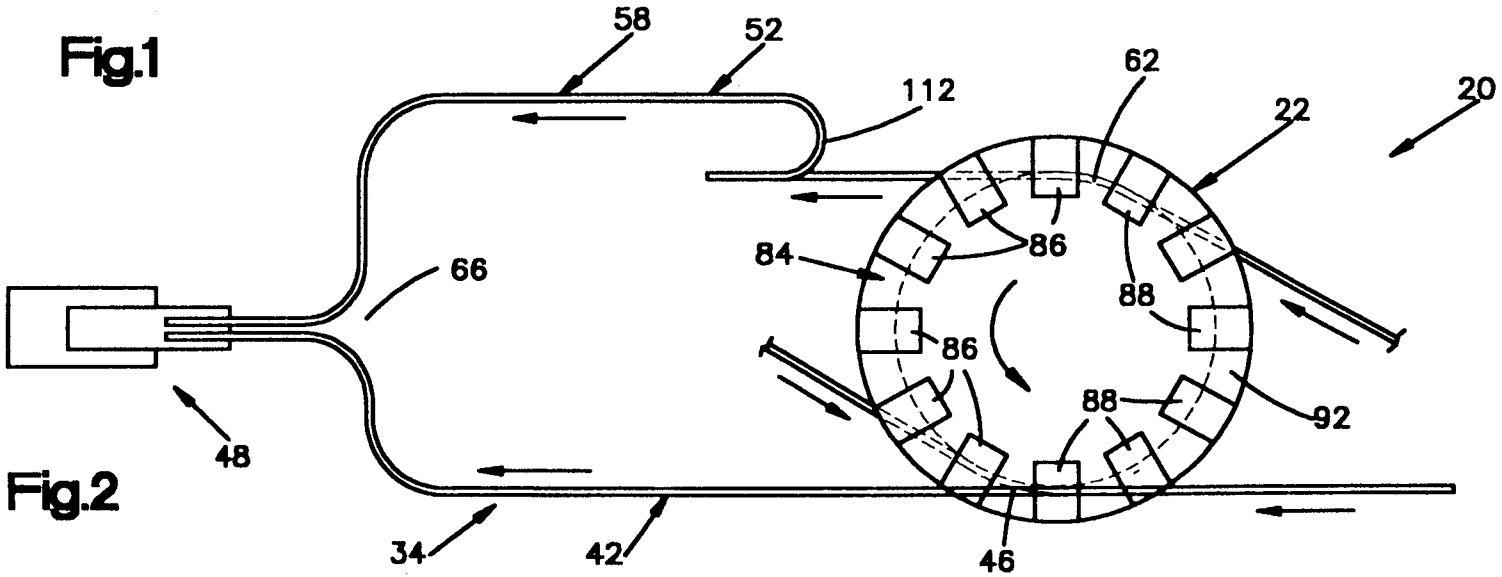
FIG. 2 is a schematic plan view, taken generally along the line 2—2 of FIG. 1, further illustrating the relationship between the collating conveyor assembly and the first and second gripper conveyor assemblies.

A sheet material handling apparatus 20 constructed and operated in accordance with one embodiment the present invention, is illustrated schematically in FIGS. 1 and 2. The sheet material handling apparatus 20 includes a collating conveyor assembly 22 which is operable to form a first series 24 (FIG. 1) of identical sheet material assemblages or articles 26 and a second series 28 of identical sheet material assemblages or articles 30. It should be understood that only a small portion of the second series 28 of sheet materal assemblages 30 is illustrated schematically in FIG. 1.

A first gripper conveyor assembly 34 has a plurality of grippers 36 (FIG. 3) which are interconnected by a conveyor chain 38 (FIG. 3) and move along a conveyor tracks indicated schematically at 42 in FIGS. 1 and 2. The grippers 36 of the first gripper conveyor assembly 34 are operable from an open condition, shown in FIG. 3, to a closed condition to sequentially grip sheet material assemblages 26 at a first delivery location 46 (FIGS. 1 and 2) disposed beneath the collating conveyor assembly 22. The first gripper conveyor assembly 34 sequentially conveys the gripped sheet material assemblages from the first delivery location 46 to a receiving location 48.

Similarly, a second gripper conveyor assembly 52 includes a plurality of grippers 54 (FIG. 1) of the same construction as the grippers 36. The grippers 54 are interconnected by a conveyor chain (not shown) and move along a second conveyor track 58. The grippers 54 of the second gripper conveyor assembly 52 are operable from an open condition to a closed condition to grip sheet material assemblages 30 at a second delivery location 62 (FIG. 2). The grippers 54 move along the second conveyor track 58 to sequentially convey the sheet material assemblages 30 of the second series 28 of sheet material assemblages to the receiving location 48.

Figure 4:
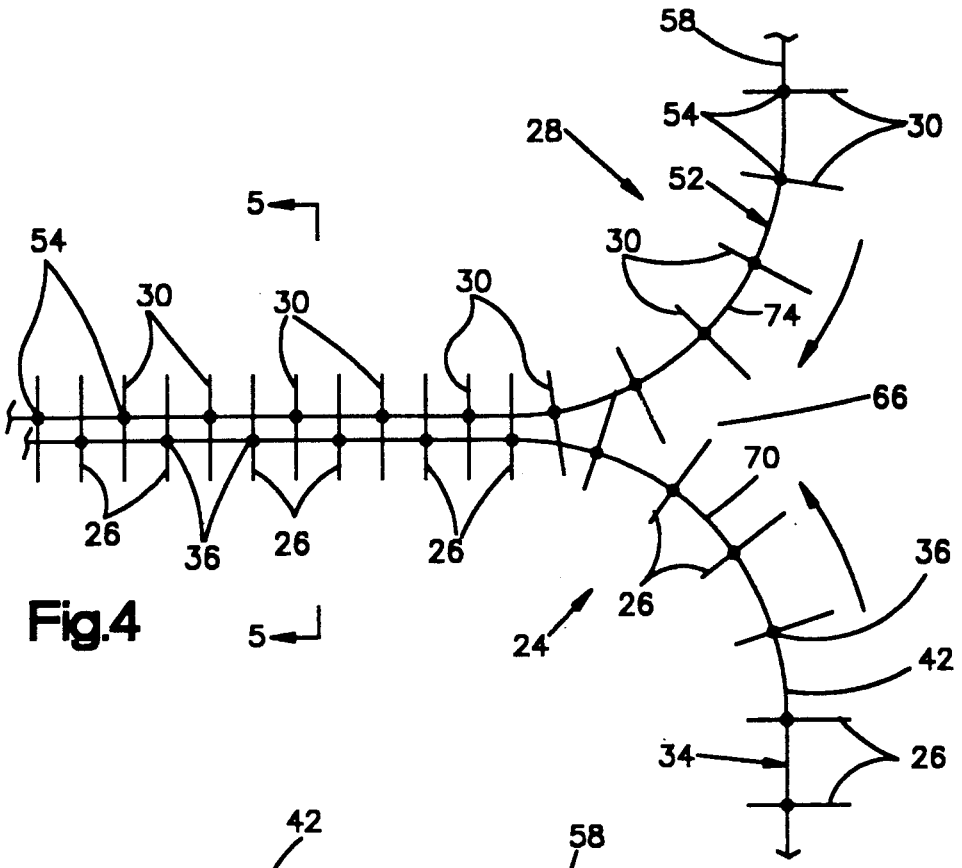
FIG. 4 is a schematic illustration depicting the interleaving of first and second series of articles with while they are being conveyed by the first and second gripper conveyor assemblies of FIG. 2.

In accordance with a feature of the invention, the first and second series 24 and 28 of sheet material assemblages 26 and 30 are interleaved while being conveyed by the first and second gripper conveyor assemblies 34 and 52 in the manner shown schematically in FIG. 4. In accordance with another feature of the invention, the interleaved sheet material assemblages 26 and 30 of the first and second series 24 and 28 of sheet material assemblages are released at the delivery location 48 in an interleaved relationship. Although it is preferred to use them together, it should be understood that these two features of the invention could be used separately. For example, the two series 24 and 28 of sheet material assemblages could be interleaved while being moved by the first and second gripper conveyor assemblies 34 and 52 without being released at the receiving location 48 in an interleaved relationship. Similarly, the sheet material assemblages 26 and 30 could be released at the receiving location 48 by the two gripper conveyors 34 and 52 in an interleaved relationship without having been interleaved before they reach the receiving location 48.

In the embodiment of the invention illustrated in FIGS. 1 and 2, the gripper conveyors 34 and 52 are being used to convey sheet material assemblages formed by the collating conveyor assembly 22. However, the conveyors 34 and 52 could be used to convey sheet material articles from sources other than the collating conveyor assembly 22.

Interleaving of Articles

The first gripper conveyor assembly 34 conveys sheet material articles, that is, the assemblages 26, from the first delivery location 46 to a merge location 66 (FIG. 2). The second gripper conveyor assembly 52 conveys sheet material articles, that is, the assemblages 30, from the second delivery location 62 to the merge location 66. At the merge location 66, the two separate streams of sheet material articles 26 and 30 are merged into one stream (FIG. 4). The single stream of sheet material articles 26 and 30 is conducted to the receiving location 48.

Although the first series 24 of sheet material articles 26 is merged with the second series 28 of sheet material articles 30 at the merge location 66 in the manner illustrated schematically in FIG. 4, the first series 24 of sheet material articles is still conveyed by the first gripper conveyor assembly 34 and the second series 28 of sheet material articles is still conveyed by a second gripper conveyor assembly 52. However, at the merge location 66, the articles 26 of the first series 24 of sheet material articles and the articles 30 of the second series 28 of sheet material articles are interleaved.

To interleave the first series 24 of sheet material articles with the second series 28 of sheet material articles at the merge location 66 (FIG. 4), an article of one series is positioned between articles of the other series. Thus, as each article 26 of the first series 24 of sheet material articles moves along a bend 70 in the first conveyor track 42, the article 26 moves between two articles 30 of the second series 28 of sheet material articles. Similarly, as each article 30 of the second series 28 of sheet material articles moves along a bend 74 in the second conveyor track 58, the article 30 moves between two articles 26 of the first series 24 of sheet material articles.

The first and second conveyor tracks 42 and 58 extend parallel to each other (FIGS. 4 and 5) from the merge area 66 to the receiving location 48 (FIG. 2) to convey interleaved articles 26 and 30 of the first and second series 24 and 28 of sheet material articles to the receiving location. The articles 26 of the first series 24 of sheet material articles and the articles 30 of the second series 28 of sheet material articles are spaced apart as they are interleaved and subsequently moved to the receiving location 48. Thus, as the articles 26 of the first series 24 of articles move around the bend 70 and are interleaved with the articles 30, the articles 26 do not engage the articles 30. Similarly, as the articles 30 move around the bend 74 and are interleaved with the articles 26, the articles 30 do not engage the articles 26.

At the merge location 66, the conveyor tracks 42 and 58 are disposed on the same level and the sheet material articles 26 and 30 are disposed beneath the tracks so that there is no interference between the sheet material articles and the tracks as the articles are interleaved. Of course, the conveyor tracks 42 and 58 are parallel to each other and are disposed on the same level as the interleaved sheet material articles 26 and 30 are conveyed from the merge location 66 to the receiving location 48. Although the conveyor tracks 42 and 58 extend along horizontal paths from the merge location 66 to the receiving location 48, the conveyor tracks could extend either upwardly or downwardly from the merge location 66.

The sheet material articles 26 and 30 are deposited at the receiving location 48 in an overlapped stream 78 (FIG. 1) by sequential opening of the grippers 36 and 54 at the receiving location 48. The first time the sheet material articles 26 and 30 move into engagement with each other is at the receiving location 48 where the overlapped stream 78 is formed. Of course, the sheet material articles 26 and 30 in the overlapped stream 78 are interleaved.

The sheet material articles 26 and 30 could be deposited at the receiving location 48 in an interleaved relationship other than an overlapped stream. For example, the sheet material articles 26 and 30 could be deposited at the receiving location 48 in a single stream with the sheet material articles interleaved and spaced apart from each other. On the other hand, the sheet material articles 26 and 30 could be stacked at the receiving location 48 in a single hopper with the sheet material articles interleaved and disposed in abutting engagement with each other. It is contemplated that it will be particularly advantageous to use a single stacker assembly at the receiving location 48 to receive and stack the interleaved sheet material articles conveyed from the two delivery locations 46 and 62 of the collating conveyor assembly 22.

As the sheet material articles 28 and 30 are interleaved, the sheet material articles are moved into alignment with each other. Before the sheet material articles 26 reach the merge location 66, they are offset to one side of the sheet material articles 30. This is because the first conveyor track 42 is offset from and are not always parallel to a second conveyor track 58 at locations ahead of the merge location 66 (see FIGS. 1 and 2). At the merge location 66, the sheet material articles 26 are rotated around the center of the horizontal arcuate bend 70 into alignment with the sheet material articles 30. Similarly, the sheet material articles 30 are rotated around the center of the horizontal arcuate bend 74 into alignment with the sheet material articles 26.

In order to enable the sheet material articles 26 and 30 to be aligned with each other after they have been interleaved, the grippers 36 and 54 of the first and second gripper conveyor assemblies 34 and 52 grip the sheet material articles 26 and 30 at locations which are offset from the center line of the articles. Thus, when a gripper 36 of the first gripper conveyor assembly 34 grips a sheet material article or assemblage 26 at the delivery station 46 (FIG. 2), the gripper assembly engages the article at a location which is offset to one side of a center line 82 of the sheet material article 26 (see FIG. 5). Similarly, when a gripper 54 of the second gripper conveyor assembly 28 grips a sheet material article or assemblage 30 at the delivery station 62 (FIG. 2), the gripper assembly engages the article at a location which is offset to one side of the center line 82 of the sheet material article 30 (see FIG. 5). To accomplish this, the first and second conveyor tracks 42 and 58 are adjusted so that the first delivery location 46 is located radially outwardly from the center of a circular collating conveyor assembly 22 further than the second delivery location 62.

Since the grippers 36 of the first gripper conveyor assembly 34 are offset to the left (as viewed in FIG. 5) of the center of the sheet material articles 26, as the articles 26 move around the bend 70 of the first conveyor track 42, they project toward the second gripper conveyor assembly 52. Similarly, since the grippers 54 of the second gripper conveyor assembly 52 are offset to the right (as viewed in FIG. 5) of the center of the sheet material articles 30, as the articles 30 move around the bend 74 of the second conveyor track 58, they project toward the first gripper conveyor assembly 34. Once the sheet material articles 26 and 30 have moved around the bends 70 and 74 and are interleaved, the sheet materials articles 26 and 30 are aligned with each other. Thus, the major side surfaces of the sheet material articles 26 and 30 extend generally parallel to each other and the edges of the sheet material articles are horizontally and vertically aligned in the manner shown in FIG. 5.

After the sheet material articles 26 and 30 have been interleaved and are moving away from the merge location 66, the grippers 36 of the first gripper conveyor assembly 34 are disposed between the sheet material articles 30 conveyed by the second gripper conveyor assembly 52. Similarly, the grippers 54 of the second gripper conveyor assembly 52 are disposed between sheet material articles 26 conveyed by the first gripper conveyor assembly 34.

Collating Conveyor Assembly

The collating conveyor assembly 22 is operable to form the two series of sheet material assemblages or articles 24 and 28. The collating conveyor assembly 22 is a known newspaper stuffing or assembling machine. The collating conveyor assembly 22 includes an arcuate array 84 of stationary hoppers. The arcuate array 84 of hoppers includes a first group of hoppers 86 of which sheet material is fed to form the assemblages 26. Similarly, the arcuate array 84 of hoppers includes a second group of hoppers 88. The sheet material to form the assemblages 30 are fed from the hoppers 88.

Figure 3:
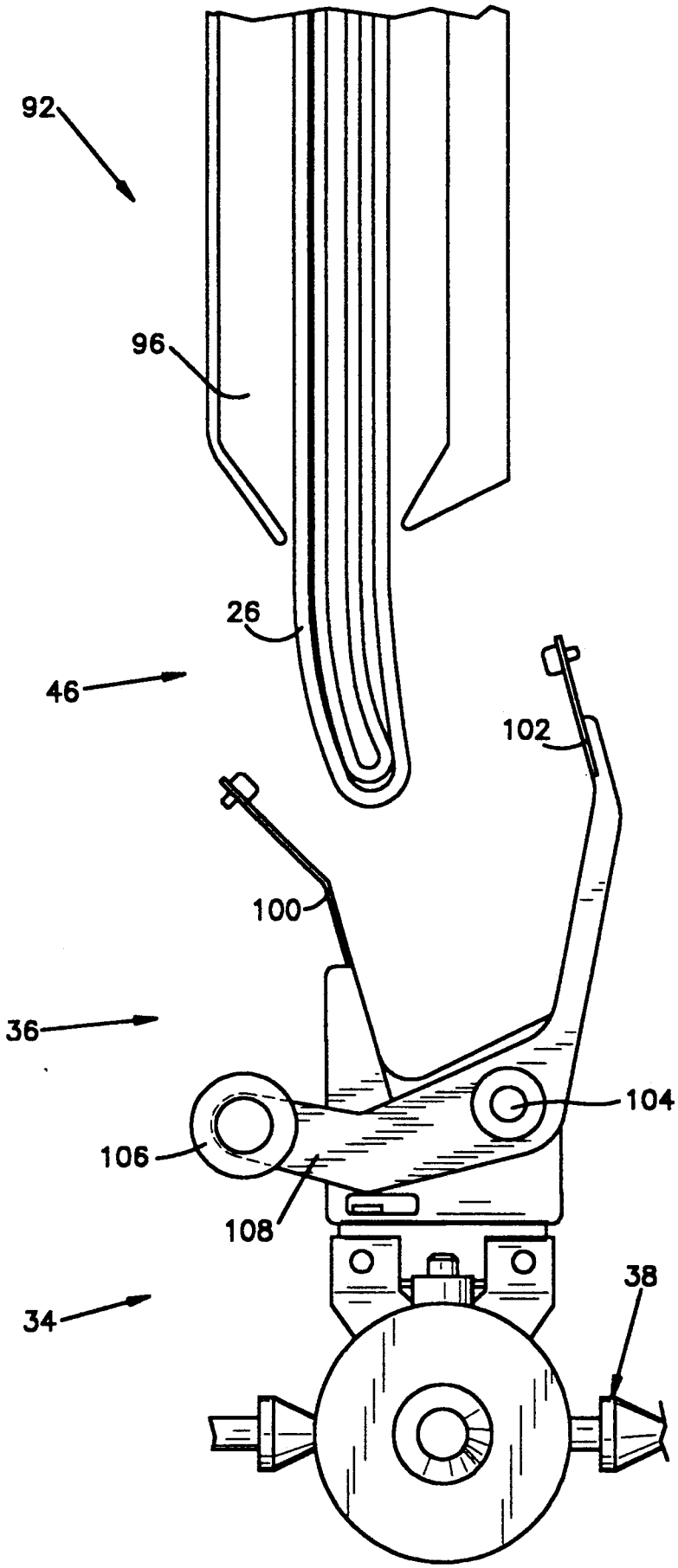
FIG. 3 is an enlarged illustration of a fully open gripper of one of the gripper conveyor assemblies and a sheet material assemblage as the assemblage is dropping from the collating conveyor assembly.

A sheet material feeder of known construction (not shown) is associated with each of the stationary hoppers 86 and 88 to feed sheet material downwardly to a plurality of collating spaces formed in a movable rotor 92. In the illustrated collating conveyor 22, the collating spaces in the rotor 92 are bottom opening pockets 96, only one of which is shown in FIG. 3. The pockets 96 are arranged in a circular array and are sequentially movable beneath the hoppers 86 and 88.

The first hopper 86 of the group of hoppers from which the sheet material for the assemblages 26 is fed, contains jacket sections. Jacket sections are sequentially fed from the first hopper in the group of hoppers 86 into the pockets 96 of the rotor 90 as the pockets move beneath the first hopper. As the rotor 90 moves the circular array of pockets in a counterclockwise direction (as viewed in FIG. 2), inner sections are fed from the other hoppers 86 into the open jacket section.

At the first delivery location 46, the bottom of each pocket 96 (FIG. 3) opens to drop a completed sheet material assemblage or article 26 downwardly into an open gripper 36 in the manner shown in FIG. 3. The gripper 36 of FIG. 3 closes to grip the assemblage 26 while the assemblage is still partially in the pocket 96 and moving forwardly with the pocket. After the gripper 36 closes to firmly grip the assemblage 26, the assemblage is pulled out of the pocket 96 and the bottom of the pocket closes as the gripper moves away from the delivery station 44.

Immediately after leaving the first delivery station 46, a jacket section for a sheet material assemblage or article 30 is fed from the first hopper 88 in the second group of hoppers. As the rotor 92 moves the circular array of pockets 96 in a counterclockwise direction (as viewed in FIG. 2), inner sections are fed from the hoppers 88 by sheet feed mechanisms. At the second delivery station 62, the pockets 96 in the rotor 92 sequentially opened to drop the completed sheet material assemblage 30 downwardly to an open gripper 54 of the second gripper conveyor assembly 52 in the same manner as is shown in FIG. 3 in conjunction with an open gripper of the gripper conveyor assembly 34.

The manner in which sheet material is fed from the hoppers into the pockets of the collating conveyor is the same as is disclosed in U.S. Pat. No. 2,461,573. However, the collating conveyor disclosed in U.S. Pat. No. 2,461,573 has only a single delivery station. Similar collating conveyors having a pair of delivery stations are disclosed in U.S. Pat. Nos. 3,881,716; 3,953,018; 4,034,974; and 4,477,067. The manner in which the sheet material assemblages or articles 26 and 30 are engaged by the grippers 36 and 54 is the same as is disclosed in U.S. Pat. No. 4,721,296.

Although a specific collating conveyor assembly 22 having a circular construction has been described herein, the collating conveyor assembly could have a different construction. For example, the collating conveyor assembly could have a linear construction similar to the construction shown in U.S. Pat. Nos. 4,236,706 and 4,499,834; and 4,641,825. Although the sheet material assemblages 26 and 30 are preferably dropped to the grippers 36 and 54 of the gripper conveyor assembly 34 and 54 from either an arcuate or linear collating conveyor, the sheet material assemblages could be transferred between conveyors in other ways if desired.

Gripper Conveyor Assemblies

The first gripper conveyor assembly 34 includes a plurality of identical grippers 36 (FIG. 3) which are interconnected by the conveyor chain 38. The conveyor chain 38 is movable at a constant speed along the first conveyor track 42. The conveyor track 42 extends in a continuous loop from a receiving location 48 to the first delivery location 46 and back to the receiving location (FIG. 2).

The grippers 36 are sequentially closed to engage sheet material articles 26 at the first delivery location 46 while the sheet material articles are being transported by the rotor 92 of the collating conveyor assembly 22. The grippers 36 are then moved along the first conveyor track 42 at a constant speed by the conveyor chain 38 to the receiving location 48. At the receiving location 48, the grippers 36 are opened and the sheet material articles 26 are dropped from the grippers.

Each of the identical grippers 36 includes a stationary clamp arm 100 (FIG. 3) which is fixedly connected to a base section of the gripper. A movable clamp arm 102 is pivotally supported on the base of the gripper for movement about the central axis of a pivot shaft 104 (FIG. 3). The gripper 36 is illustrated in FIG. 3 in a fully open and upwardly facing position.

To grip a sheet material article 26, the movable clamp arm 102 is rotated toward the stationary clamp arm 100. To rotate the movable clamp arm 102, a roller 106 on an actuator arm 108 engages a stationary cam at the first delivery location 46. This rotates the movable clamp arm 102 in a counterclockwise direction (as viewed in FIG. 3) from the illustrated fully open position to a closed position to grip a sheet material article 26. A clutch assembly (not shown) is operable to hold the movable clamp arm in the closed position. Once the gripper 36 has engaged the sheet material article 26 at the delivery location 46, the gripper remains in a closed condition firmly gripping the sheet material article. The conveyor chain 38 moves the gripper 36 and the gripped sheet material article along the track 42 to the receiving location 48. As the gripper 36 moves from the first delivery station 46 to the receiving station 48, the gripper is inverted from the upwardly facing orientation shown in FIG. 3 to a downwardly facing orientation.

At the receiving location 48, an actuator lever (not shown) projecting from the side of the gripper opposite from the actuator arm 108, engages a stationary abutment. Engagement of the actuator lever with the stationary abutment operates the clutch assembly in the gripper to release the movable clamp arm 102 for movement from the closed position back to the fully open position under the influence of a biasing spring. This results in the sheet material article being dropped at the receiving location 48.

The second gripper conveyor assembly 52 has the same general construction and mode of operation as the first gripper conveyor assembly 34. Thus, the second gripper conveyor assembly 32 includes a plurality of identical grippers 54 having the same construction as the grippers 36. The grippers 34 are interconnected by a conveyor chain having the same construction as the conveyor chain 38. The conveyor chain and grippers 54 of the second gripper conveyor assembly 52 are movable at a constant speed along the second conveyor track 58. The second conveyor track 58 extends in a continuous loop from the second delivery location 62 to the receiving location 48 and back to the second delivery location 62. Of course, the second conveyor track 58 extends along a path having a different configuration than the path along which the conveyor track 42 extends.

The grippers 54 are sequentially closed to engage sheet material articles 30 at the second delivery station 62 while the sheet material articles are being transported by the rotor 92 of the collating conveyor assembly 22. The grippers 54 are then moved along the second conveyor track 58 at a constant speed from the second delivery location 62 to the receiving location 48. At the receiving location 48, the grippers 54 of the sheet material articles 30 are dropped from the grippers.

Once a gripper 54 has engaged a sheet material article at the second delivery location 62, the gripper remains in a closed condition firmly gripping the sheet material article. The conveyor chain in the second gripper conveyor assembly 52 then moves the gripper 54 and a sheet material article 30 along the track 58 from the second delivery location 62 beneath the collating conveyor 26 to an vertically upwardly extending section of the conveyor track 58, a portion of which has been shown schematically in FIG. 1. The second gripper assembly 54 is then moved onto a horizontal section of track which extends back toward the collating conveyor assembly 22. At this time, the gripper assembly 54 is in a downwardly facing orientation. The gripper assembly then moves along a bend 112 (FIG. 2) in the second conveyor track 58 and then along the track to the receiving station 48 with the gripper in the downwardly facing orientation.

At the receiving station 48, an actuator lever projecting from the side of the gripper assembly 54 engages a stationary abutment. Engagement of the actuator lever with the stationary abutment operates the gripper assembly 54 to release the sheet material article at the receiving station 48. Although the gripper assemblies 36 and 54 could have many different constructions, such as the construction shown in U.S. Pat. No. 4,381,056, the gripper assemblies 36 and 54 and conveyor chain 38 have the same construction as shown in U.S. Pat. Nos. 4,638,906 and 4,681,213.

Gripper Conveyor Assemblies—Second Embodiment

Figure 6:
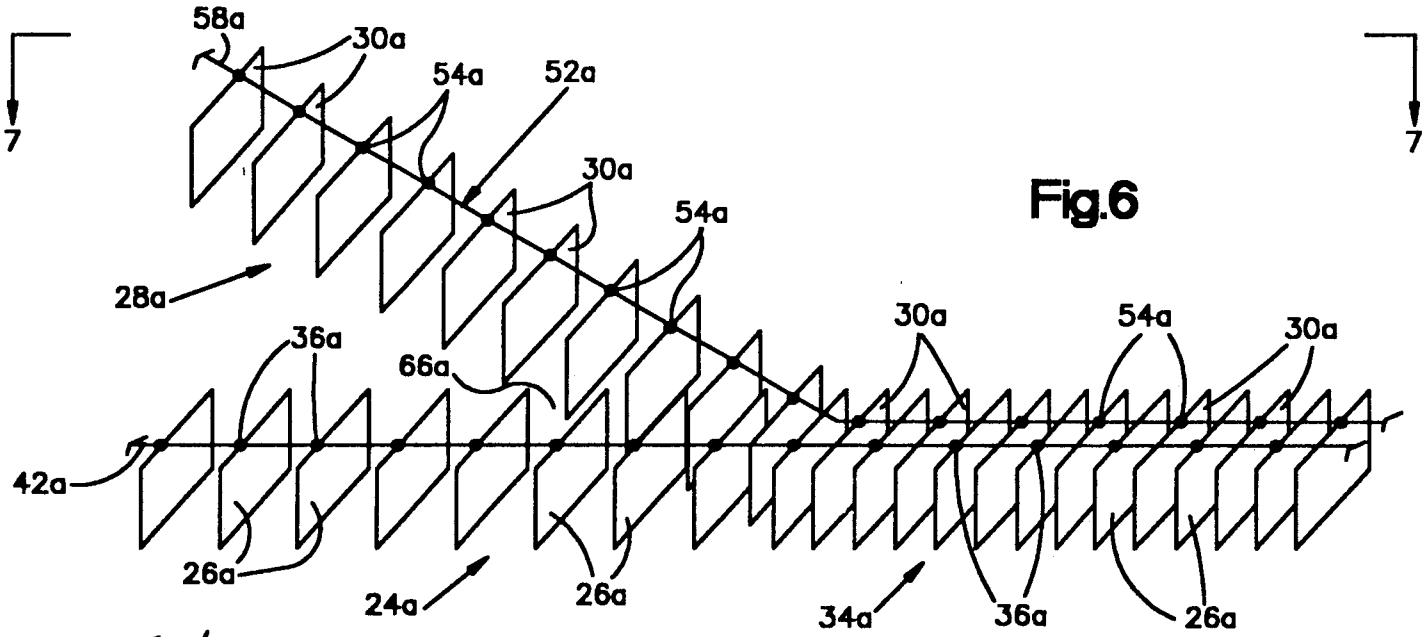
FIG. 6 is a schematic pictorial illustration of another embodiment of the invention and depicting the manner in which a first series of sheet material articles move downwardly into an interleaved relationship with a second series of sheet material articles moving along a horizontal linear path.
Figure 7:
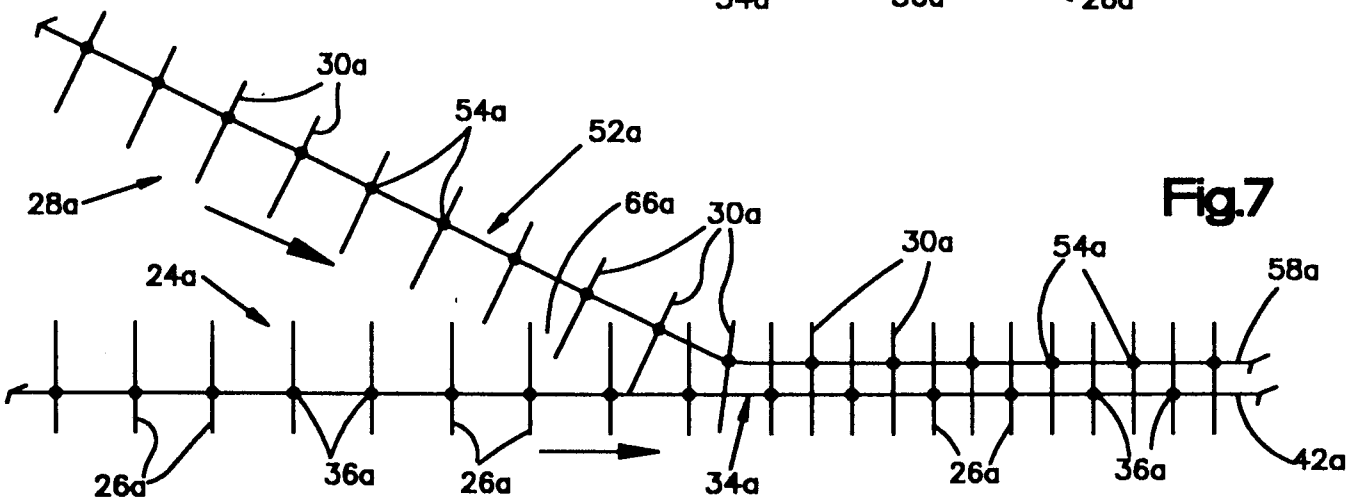
FIG. 7 is a schematic plan view, taken generally along the line 7—7 of FIG. 6, further illustrating the manner in which the two series of sheet material articles are interleaved.

In the embodiment of the invention illustrated in FIGS. 1–5, the first and second gripper conveyor assemblies 34 and 52 interleave the sheet material articles 26 and 30 at the merge location 66 with the conveyor tracks 42 and 58 on the same horizontal level. In the embodiment of the invention illustrated in FIGS. 6 and 7, one of the conveyor tracks enters the merge location at a level above the other conveyor track with the result that the sheet material articles are interleaved by bringing them both vertically and horizontally together. Since the embodiment of the invention illustrated in FIGS. 6 and 7 is generally similar to the embodiment of the invention illustrated in FIGS. 1–5, similar numerals will be utilized to designate similar components, the suffix letter "a" being associated with the numerals of FIGS. 6 and 7 to avoid confusion.

A first gripper conveyor assembly **34*a* conducts a first series 24*a* of sheet material articles to a merge location 66*a*. Similarly, a second gripper conveyor assembly 52*a* conveys a second series 28*a* of sheet material articles 30*a* to the merge location 66*a*. The first gripper conveyor assembly 34*a* has a track 42*a* which extends along a linear horizontal path into and out of the merge location 66*a*. The second gripper conveyor assembly 52*a* has a track 58*a* which slopes vertically downwardly and horizontally sidwardly to the merge location 66*a* and then extends along a linear horizontal path away from the merge location 66*a***.

The conveyor tracks **42*a* and 58*a* extend parallel to each other and are at the same level as they extend away from the merge location 66*a***.

At the merge location **66*a*, the two separate streams of sheet material articles 26*a* and 30*a* are merged into a single stream which is conveyed to a receiving location. Although the two streams of sheet material articles 26*a* and 30*a* are merged into a single stream at the merge location 66*a*, the first series of sheet material articles 26*a* is still conveyed by the first gripper conveyor assembly 34*a* and the second series of sheet material articles is still conveyed by the gripper conveyor assembly 52*a* downstream from the merge location 66*a*. However, at the merge location 66*a*, the articles of the first and second series 24*a* and 28*a*** of sheet material articles are interleaved. Thus, a sheet material article of one of the two series of sheet material articles is positioned between sheet material articles of the other series of sheet material articles.

As each sheet material article **26*a* of the first series 24*a* of sheet material articles approaches the merge location 66*a*, the articles are moving along a straight horizontal path. At the merge location 66*a*, the sheet material articles 26*a* move between sheet material articles 30*a* of the second series 28*a* of sheet material articles. As each sheet material article 30*a* of the second series 28*a* of sheet material articles is moved downwardly and material article 30*a* of the second series of sheet material articles moves between a sheet material article 26*a* of the first series 24*a* of sheet material articles. As the sheet material articles 30*a* are moved downwardly along the conveyor track 58*a* toward the merge location 66*a*, each article 30*a* first enters between a pair of the sheet material articles 26*a*. As a sheet material article moves between a pair of sheet material articles 26*a*, an edge portion of the sheet material article moves beneath the horizontal first conveyor track 42*a***.

At the merge location **66*a*, the conveyor track 58*a* turns (FIG. 7) and extends parallel to the conveyor track 42*a* and is on the same level as the conveyor track 42*a*. During the interleaving of the sheet material articles 26*a* and 30*a*, the sheet material articles are maintained in a spaced apart relationship and do not bump into each other or into a conveyor track. It should be understood that although the conveyor track 58*a* has been illustrated in FIGS. 6 and 7 as taking a sharp turn at the merge location 66*a*, the conveyor track 58*a* could extend downwardly along an arcuate curve to the merge location 66*a***.

Figure 5:
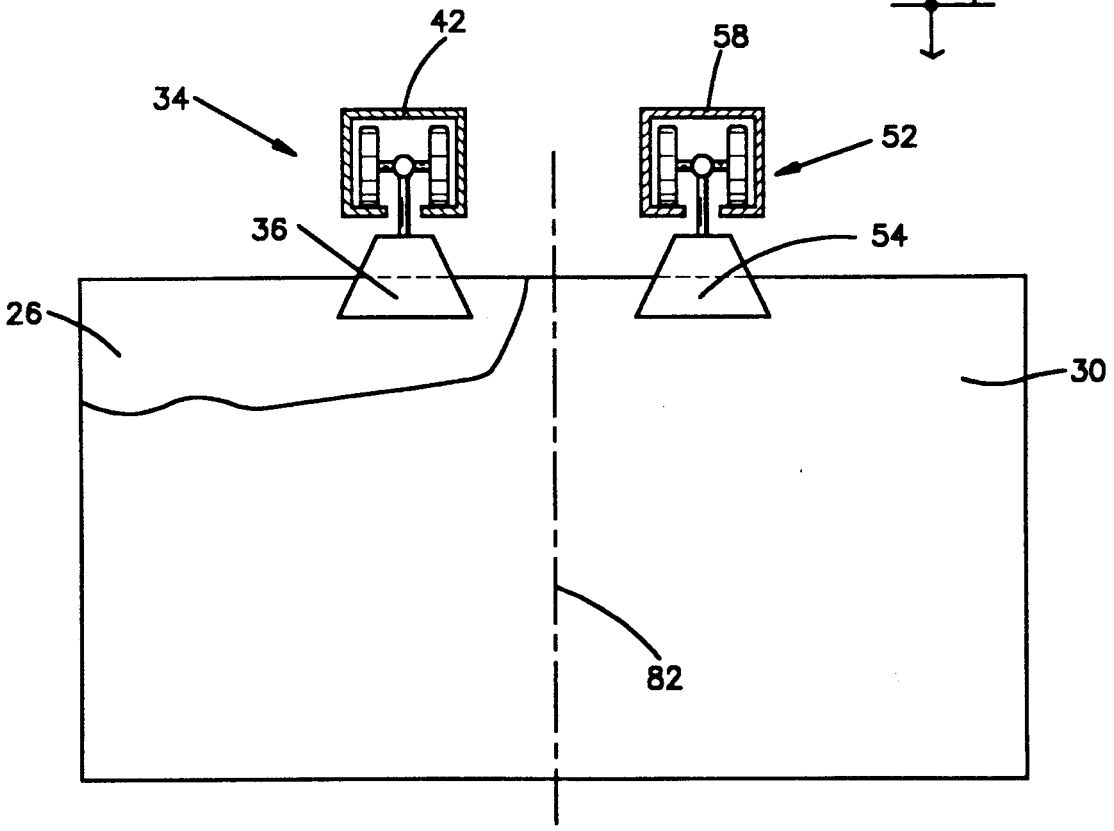
FIG. 5 is a schematic illustration, taken generally along the line 5—5 of FIG. 4, depicting the relationship between the grippers of the first and second gripper conveyor assemblies and interleaved sheet material articles.

The sheet material articles **26*a* and 30*a* move away from the merge location 66*a* in an interleaved relationship with the edges of the sheet material articles horizontally and vertically aligned in the same manner as shown in FIG. 5. As the sheet material articles 26*a* and 30*a* move along the conveyor tracks 42*a* and 58*a* away from the merge location 66*a*, the spaced apart major side surfaces of the articles are vertical and parallel to each other. The interleaved sheet material articles 26*a* and 30*a* move along the parallel conveyor tracks 42*a* and 58*a* to a receiving location (not shown) corresponding to the receiving location 48 of FIGS. 1 and 2**. At the receiving location, the sheet material articles are released in an interleaved relationship.

Gripper Conveyor Assemblies—Third Embodiment

Figure 8:
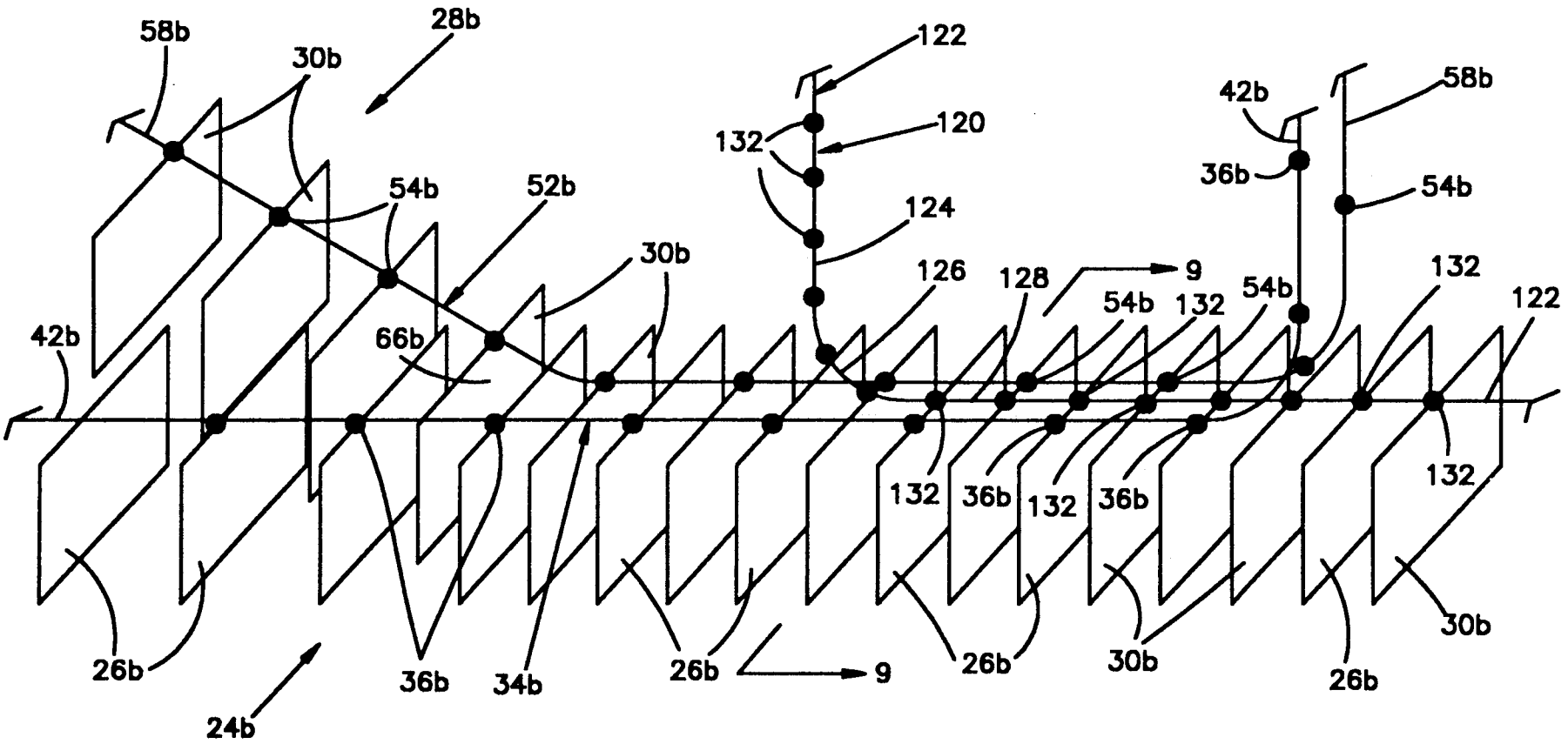
FIG. 8 is a schematic pictorial illustration, generally similar to FIG. 6, depicting another embodiment of the invention in which two series of sheet material articles are interleaved while being conveyed by first and second gripper conveyor assemblies and are subsequently engaged and conveyed by a third gripper conveyor assembly.
Figure 9:
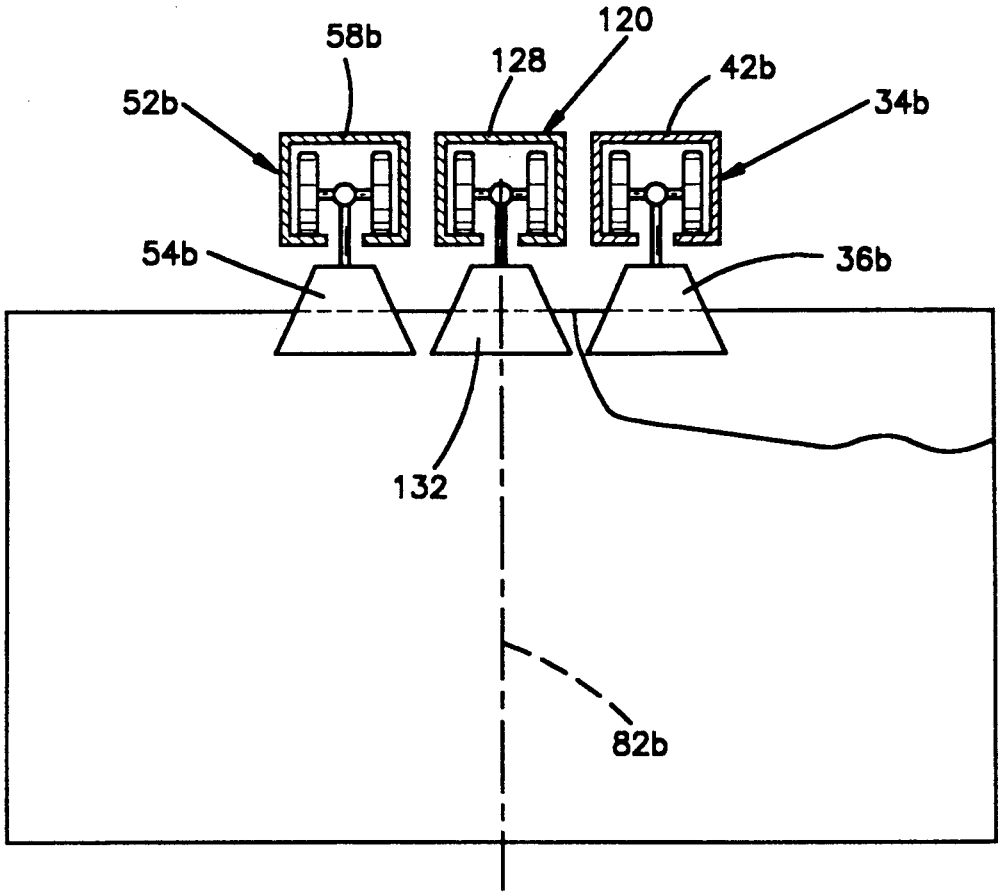
FIG. 9 is an elevational view, taken generally along the line 9—9, illustrating the relationship between grippers of the first, second and third gripper conveyor assemblies.

In the embodiments of the invention illustrated in FIGS. 1–7, first and second series of sheet material articles are interleaved while being conveyed to a receiving location by first and second gripper conveyor assemblies. In the embodiment of the invention illustrated in FIGS. 8 and 9, a third conveyor assembly grips the interleaved sheet material articles being conveyed by the first and second conveyor assemblies and moves the sheet material articles to a receiving location. Therefore, after the sheet material articles have been gripped by the third conveyor assembly, both series of sheet material articles are conveyed by the same conveyor assembly. Since the embodiment of the invention illustrated in FIGS. 8 and 9 is generally similar to the embodiment of the invention illustrated in FIGS. 1–7, similar numerals will be utilized to designate similar components, the suffix letter "b" being associated with the components of FIGS. 8 and 9 to avoid confusion.

A first series **24*b* of sheet material articles 26*b* are conveyed to a merge location 66*b* along a straight horizontal conveyor track 42*b* by a gripper conveyor assembly 34*b*. A second series 28*b* of sheet material articles 30*b* are conveyed downwardly and sidewardly to the merge location 66*b* along a second conveyor track 58*b* by a gripper conveyor assembly 52*b*. At the merge location 66*b*, the sheet material articles 26*b* and 30*b* are interleaved in the manner previously explained in conjunction with the embodiment of the invention shown in FIGS. 6 and 7**.

Downstream from the merge location **66*b*, the conveyor tracks 42*b* and 58*b* extend parallel to each other. After the merge location 66*b***, the sheet material articles 26*b* and 30*b* are aligned with each other in the same manner as illustrated in FIG. 5. At this time, the major side surfaces of the articles 26*b* and 30*b* extend parallel to each other and perpendicular to the horizontal conveyor tracks 42*b* and 58*b*.

In accordance with a feature of this embodiment of the invention, a third gripper conveyor assembly 120 (FIG. 8) grips the first series 24*b* of sheet material articles 26*b* and the second series 28*b* of sheet material articles 30*b* while they are interleaved and being conveyed by the first and second gripper conveyor assemblies 34*b* and 52*b*. The third gripper conveyor assembly 120 includes a conveyor track 122 having a vertical section 124 which extends perpendicular to the conveyor tracks 42*b* and 58*b* downstream from the merge location 66*b*. An arcuate bend 126 connects the vertical section 124 of the conveyor track 122 with a horizontal section 128 of the conveyor track. The horizontal section 128 of the conveyor track 122 is disposed midway between the conveyor tracks 42*b* and 58*b* and extends parallel to the conveyor tracks 42*b* and 58*b* (see FIGS. 8 and 9).

The third gripper conveyor assembly 120 includes a plurality of grippers 132. The grippers 132 are spaced apart by a distance which is equal to one-half of the spacing between the grippers 36*b* and one-half of the spacing between the grippers 54*b*.

As the grippers 132 of the third gripper conveyor assembly 120 move along the bend 126 in the conveyor track 122, the grippers 132 grip each of the sheet material articles 26*b* and 30*b* in turn. Thus, immediately after the bend 126 in the conveyor track 122, each sheet material article is gripped by two grippers (FIG. 9). Each of the sheet material articles 26*b* and 30*b* is gripped by one of the grippers 132 of the third conveyor assembly 120. Each of the sheet material articles 26*b* is also gripped by one of the grippers 36*b* of the first gripper conveyor assembly 24*b*. Each of the sheet material articles 30*b* is also gripped by one of the grippers 54*b* of the second gripper conveyor assembly 28*b*. The grippers 132 of the third gripper conveyor assembly 120 grip each of the sheet material articles 26*b* and 30*b* along the central axes 82*b* of the sheet material articles (FIG. 9).

After a sheet material article 26*b* has been firmly engaged by a gripper 132 of the third conveyor assembly 120, the gripper 36*b* of the first gripper conveyor assembly 34*b* which also engages the sheet material article, is actuated to the open condition to release the sheet material article. Similarly, after a gripper 132 of the third gripper conveyor assembly has gripped a sheet material article 30*b*, the gripper 54*b* of the second gripper conveyor assembly 52*b* which also engages the sheet material article, is actuated to an open condition. This results in the sheet material articles 26*b* and 30*b* being conveyed by only the third gripper conveyor assembly 120. The gripper conveyor assembly 120 conveys the interleaved sheet material articles 26*b* and 30*b* to a receiving location (not shown) where the sheet material articles are released in an interleaved relationship.

Gripper Conveyor Assemblies—Fourth Embodiment

In the embodiment of the invention illustrated in FIGS. 7 and 8, the second gripper conveyor assembly moves sheet material articles downwardly and sidewardly into an interleaved relationship with a linear portion of a first gripper conveyor assembly. In the embodiment of the invention illustrated in FIG. 10, a gripper conveyor assembly disposed on the same level as a linear gripper conveyor assembly moves sheet material articles into an interleaved relationship with sheet material articles conveyed by the linear gripper conveyor assembly. Since the embodiment of the invention illustrated in FIG. 10 is generally similar to the embodiment of the invention illustrated in FIGS. 1–9, similar numerals will be utilized to designate similar components, the suffix letter "c" being associated with the numerals of FIG. 10 to avoid confusion.

Figure 10:
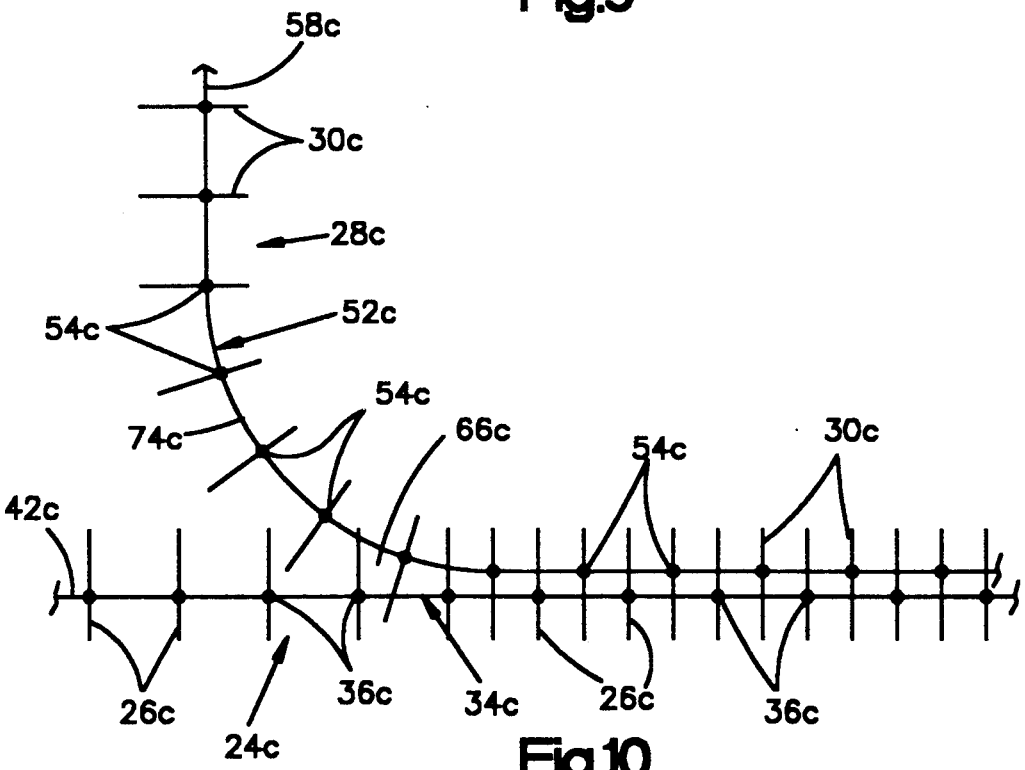
FIG. 10 is a schematic illustration of another embodiment of the invention and depicting the manner in which arcuate and linear streams of sheet material articles are interleaved.

In the embodiment of the invention illustrated in FIG. 10, a first gripper conveyor assembly 34*c* conveys a series 24*c* of sheet material articles 26*c* along a linear track 42*c*. Similarly, a second gripper conveyor assembly 52*c* conveys a series 28*c* of sheet material articles 30*c* along a conveyor track 58*c* to the merge location 66*c*. At the merge location 66*c*, the sheet material articles 30*c* are interleaved with the sheet material articles 26*c* in the manner previously explained in conjunction with the embodiment of the invention illustrated in FIGS. 1–5.

The first gripper conveyor assembly 34*c* moves the sheet material articles 26*c* along a horizontal linear path. The second gripper conveyor assembly 52*c* moves the sheet material articles 30*c* along the conveyor track 58*c* having a bend 74*c*. Immediately before, at and after the merge location 66*c*, the second conveyor track 58*c* is disposed on the same level as the conveyor track 42*c*. After the merge location 66*c*, the conveyor tracks 42*c* and 58*c* extend parallel to each other.

CONCLUSION

In view of the foregoing description, it is apparent that the present invention provides a new and improved method and apparatus 20 to interleave a first series 24 of articles 26 with a second series 28 of articles 30. The first and second series 24 and 28 of articles may be interleaved with the first series of articles being conveyed by a first conveyor 34 and the second series of articles is being conveyed by the second conveyor 52. By conveying both series 24 and 28 of articles 26 and 30 in an interleaved relationship to a single receiving location 48, duplication of equipment and personnel effort at the receiving location is minimized.

In one embodiment of the invention, a collating conveyor assembly 22 (FIGS. 1 and 2) forms two separate series 24 and 28 of sheet material assemblages 26 and 30. A first series 24 of sheet material assemblages 26 is delivered to a first delivery location 46 by the collating conveyor assembly 22. A second series 28 of sheet material assemblages 30 is delivered to a second delivery location 62 by the collating conveyor assembly 22. First and second gripper conveyor assemblies 34 and 52 engage the first and second series 24 and 28 of assemblages 26 and 30 at the delivery locations 46 and 62 and transport them away from the collating conveyor assembly 22. The gripper conveyor assemblies 34 and 52 release the sheet material assemblages 26 and 30 in an interleaved relationship at a receiving location 48.

In the illustrated embodiments of the invention, the first and second gripper conveyor assemblies 34 and 52 converge at a merge location 66 to interleave sheet material articles 26 and 30. However, it is contemplated that the first and second gripper conveyor assemblies 34 and 52 could be operated in a reverse the direction. If this was done, the sheet material articles 26 and 30 would move from an interleaved relationship to a separated relationship by diverging the two streams of sheet material articles at a location corresponding to the merge location 66.

It should also be understood that although it is preferred to use the gripper conveyor assemblies 34 and 52 in conjunction with the collating conveyor assembly 22 of FIGS. 1 and 2, the gripper conveyor assemblies 34 and 52 could be used with other known devices or could be used to merge two streams of material conducted from completely different sources to form a single stream of interleaved articles. Although it is preferred to merge two streams of sheet material articles 26 and 30 to interleave the articles before they reach the receiving location 48, the conveyor assemblies 34 and 52 could be constructed to interleave the articles 26 and 30 at the receiving location if desired.

Having described specified preferred embodiments of the invention, the following is claimed:

1. Sheet material handling apparatus comprising a plurality of hoppers for holding sheet material, said plurality of hoppers including a first group of hoppers and a second group of hoppers, a conveyor assembly defining a plurality of collating spaces movable past each of said hoppers in turn, first feed means for feeding sheet material from the first group of hoppers to each of said collating spaces in turn during movement of said collating spaces past the first group of hoppers to sequentially form a first series of sheet material assemblages, second feed means for feeding sheet material from the second group of hoppers to each of said collating spaces in turn during movement of said collating spaces past the second group of hoppers to sequentially form sheet material assemblages of a second series of sheet material assemblages, first gripper conveyor means for sequentially gripping sheet material assemblages of the first series of sheet material assemblages being transported by said conveyor assembly at a first delivery location, for sequentially conveying the sheet material assemblages of the first series of sheet material assemblages to a receiving location, and for sequentially releasing sheet material assemblages of the first series of sheet material assemblages at the receiving location in an interleaved relationship with sheet material assemblages of the second series of sheet material assemblages, said first gripper conveyor means including a first plurality of grippers each of which is operable from an open condition to a closed condition to clampingly grip a sheet material assemblage of the first series of sheet material assemblages at the first delivery location and operable from a closed condition to an open condition to release a sheet material assemblage of the first series of sheet material assemblages at the receiving location in an interleaved relationship with a sheet material assemblage of the second series of sheet material assemblages, second gripper conveyor means for sequentially gripping sheet material assemblages of the second series of sheet material assemblages being transported by said conveyor assembly a second delivery location, for sequentially conveying the sheet material assemblages of the second series of sheet material assemblages to the receiving location, and for sequentially releasing sheet material assemblages of the second series of sheet material assemblages at the receiving location in an interleaved relationship with sheet material assemblages of the first series of sheet material assemblages, said second gripper conveyor means including a second plurality of grippers each of which is operable from an open condition to a closed condition to clampingly grip a sheet material assemblage at the second delivery location and operable from a closed condition to an open condition to release a sheet material assemblage of the second series of sheet material assemblages at the receiving location in an interleaved relationship with a sheet material assemblage of the first series of sheet material assemblages.

2. Sheet material handling apparatus as set forth in claim 1 wherein said first and second gripper conveyor means include means for interleaving the first series of sheet material assemblages with the second series of sheet material assemblages while the first series of sheet material assemblages is being conveyed by said first gripper conveyor means and the second series of sheet material assemblages in being conveyed by said second gripper conveyor means.

3. Sheet material handling apparatus as set forth in claim 1 wherein said means for interleaving the first series of sheet material assemblages with the second series of sheet material assemblages includes means for maintaining the first series of sheet material assemblages spaced apart from the second series of sheet material assemblages while they are being conveyed by said first and second gripper conveyor means.

4. Sheet material handing apparatus as set forth in claim 2 wherein each one of the grippers of said first plurality of grippers is at least partially disposed between sheet material assemblages of said second series of sheet material assemblages when the sheet material assemblage gripped by one of said first plurality of grippers is interleaved with sheet material assemblages of the second series of sheet material assemblages and is being conveyed by said first gripper conveyor means, each one of the grippers of said second plurality of grippers is at least partially disposed between sheet material assemblages of said first series of sheet material assemblages when the sheet material assemblage gripped by one of said second plurality of grippers is interleaved with sheet material assemblages of the first series of sheet material assemblages and is being conveyed by said second gripper conveyor means.

5. Sheet material handling apparatus as set forth in claim 1 wherein said first gripper conveyor means includes means for moving sheet material assemblages of the first series of sheet material assemblages along a first path length in which sheet material assemblages of the first series of sheet material assemblages are offset to one side of sheet material assemblages of the second series of sheet material assemblages and for moving sheet material assemblages of the first series of sheet material assemblages along a second path length in which sheet material assemblages of the first series of sheet material assemblages are interleaved with sheet material assemblages of the second series of sheet material assemblages, the sheet material assemblages of the first series of sheet material assemblages being spaced apart from sheet material assemblages of the second series of sheet material assemblages during movement of sheet material assemblages of the first series of sheet material assemblages along the second path length.

6. Sheet material handling apparatus as set forth in claim 1 wherein said plurality of hoppers are disposed in a circular array, said conveyor assembly including means for moving said plurality of collating spaces along a circular path beneath each of said hoppers in turn, said first gripper conveyor means including means for sequentially moving the first plurality of grippers beneath the circular path of movement of said collating spaces at the first delivery location, said second gripper conveyor means including means for sequentially moving the second plurality of grippers beneath the circular path of movement of said collating spaces at the second delivery station 7. Sheet material handling apparatus comprising a plurality of hoppers for holding sheet material, said plurality of hoppers including a first group of hoppers and a second group of hoppers, a conveyor assembly defining a plurality of collating spaces movable past each of said hoppers in turn, first feed means for feeding sheet material from the first group of hoppers to each of said collating spaces in turn during movement of said collating spaces past the first group of hoppers to sequentially form a first series of sheet material assemblages, second feed means for feeding sheet material from the second group of hoppers to each of said collating spaces in turn during movement of said collating spaces past the second group of hoppers to sequentially form sheet material assemblages of the second series of sheet material assemblages, first gripper conveyor means for sequentially gripping sheet material assemblages of the first series of sheet material assemblages being transported by said conveyor assembly at a first delivery location, for sequentially conveying the sheet material assemblages of the first series of sheet material assemblages, and for interleaving sheet material assemblages of the first series of sheet material assemblages with sheet material assemblages of the second series of sheet material assemblages while the first series of sheet material assemblages is being conveyed by said first gripper conveyor means, said first gripper conveyor means including a first plurality of grippers each of which is operable from an open condition to a closed condition to clampingly grip a sheet material assemblage of the first series of sheet material assemblages at the first delivery location and operable from a closed condition to an open condition to release a sheet material assemblage of the first series of sheet material assemblages, second gripper conveyor means for sequentially gripping sheet material assemblages of the second series of sheet material assemblages being transported by said conveyor assembly at a second delivery location, for sequentially conveying the sheet material assemblages of the second series of sheet material assemblages, and for interleaving sheet material assemblages of the second series of sheet material assemblages with sheet material assemblages of the first series of sheet material assemblages while the second series of sheet material assemblages is being conveyed by said second gripper conveyor means, said second gripper conveyor means including a second plurality of grippers each of which is operable from an open condition to a closed condition to clampingly grip a sheet material assemblage of the second series of sheet material assemblages at the second delivery location and operable from a closed condition to an open condition to release a sheet material assemblage of the second series of sheet material assemblages.

8. Sheet material handing apparatus as set forth in claim 7 wherein each one of the grippers of said first plurality of grippers is at least partially disposed between sheet material assemblages of said second series of sheet material assemblages when the sheet material assemblage gripped by one of said first plurality of grippers is interleaved with sheet material assemblages of said second series of sheet material assemblages and is being conveyed by said first gripper conveyor means, each one of the grippers of said second plurality of grippers is at least partially disposed between sheet material assemblages of said first series of sheet material assemblages when the sheet material assemblage gripped by one of said second plurality of grippers is interleaved with sheet material assemblages of said first series of sheet material assemblages and is being conveyed by said second gripper conveyor means 9. Sheet material handling apparatus as set forth in claim 7 wherein said first gripper conveyor means includes means for moving sheet material assemblages of the first series of sheet material assemblages along a first path length in which sheet material assemblages of the first series of sheet material assemblages are offset to one side of sheet material assemblages of the second series of sheet material assemblages and for moving sheet material assemblage of the first series of sheet material assemblages along a second path length in which sheet material assemblages of the first series of sheet material assemblages are interleaved with sheet material assemblage of the second series of sheet material assemblages, the sheet material assemblages of the first series of sheet material assemblages being spaced apart from sheet material assemblages of the second series of sheet material assemblages during movement of sheet material assemblages of the first series of sheet material assemblages along the second path length.

10. A method of handling sheet material, said method comprising the steps of forming first and second series of sheet material assemblages, sequentially gripping sheet material assemblages of the first series of sheet material assemblages with grippers of a first gripper conveyor, sequentially gripping sheet material assemblages of the second series of sheet material assemblages with grippers of a second gripper conveyor, sequentially conveying gripped sheet material assemblages of the first series of sheet material assemblages with the first gripper conveyor, sequentially conveying gripped sheet material assemblages of the second series of sheet material assemblages with the second gripper conveyor, while performing said steps of conveying sheet material assemblages with said first and second gripper conveyors, interleaving sheet material assemblages of the first and second series of sheet material assemblages, and, thereafter, sequentially releasing the gripped sheet material assemblages of the first and second series of sheet material assemblages at a receiving location in such a manner as to have the released sheet material assemblages of the first series of sheet material assemblages interleaved with released sheet material assemblages of the second series of sheet material assemblages.

11. A method as set forth in claim 10 wherein said step of forming first and second series of sheet material assemblages includes sequentially moving a plurality of collating spaces past a first group of hoppers and past a second group of hoppers, feeding sheet material from the first group of hoppers to each of the collating spaces in turn during movement of the collating spaces past the first group of hoppers to sequentially form the first series of sheet material assemblages, feeding sheet material from the second group of hoppers to each of the collating spaces in turn during movement of the collating spaces past the second group of hoppers to sequentially form the second series of sheet material assemblages, said method further including sequentially dropping sheet material assemblages of the first series of sheet material assemblages downwardly to grippers of the first gripper conveyor and sequentially dropping sheet material assemblages of the second series of sheet material assemblages downwardly to grippers of the second gripper conveyor.

12. A method as set forth in claim 10 wherein said step of forming first and second series of sheet material assemblages includes sequentially moving a plurality of collating spaces past a first group of hoppers and past a second group of hoppers, feeding sheet material from the first group of hoppers to each of the collating spaces in turn during movement of the collating spaces past the first group of hoppers to sequentially form the first series of sheet material assemblages, feeding sheet material from the second group of hoppers to each of the collating spaces in turn during movement of the collating spaces past the second group of hoppers to sequentially form the second series of sheet material assemblages, said step of sequentially gripping sheet material assemblages of the first series of sheet material assemblages with grippers of the first gripper conveyor including gripping sheet material assemblages with the grippers of the first gripper conveyor while the sheet material assemblages are moving with the collating spaces, said step of sequentially gripping sheet material assemblages of the second series of sheet material assemblages with grippers of the second gripper conveyor includes gripping sheet material assemblages with grippers of the second gripper conveyor while the sheet material assemblages are moving with the collating spaces.

13. Sheet material handling apparatus comprising first conveyor means for conveying a first series of sheet material articles with the articles spaced apart from each other, second conveyor means for conveying a second series of sheet material articles with the articles spaced apart from each other, said first and second conveyor means including means for interleaving the first series of articles and the second series of articles with each other while the first series of articles is conveyed by said first conveyor means and the second series of articles is conveyed by said second conveyor means, said first conveyor means including a plurality of first gripper means each of which grips an article of the first series of articles while the article is conveyed by said first conveyor means, said second conveyor means including a plurality of second gripper means each of which grips an article of the second series of articles while the article is conveyed by said second conveyor means, each of the gripper means of said first gripper means being at least partially disposed between articles of the second series of articles when the article gripped by one of said first gripper means is interleaved with articles of the second series of articles, each one of the gripper means of said second gripper means being at least partially disposed between articles of the first series of articles when the articles gripped by one of said second gripper means is interleaved with articles of said second series of articles.

14. Sheet material handling apparatus as set forth in claim 13 wherein said means for interleaving the first series of articles with the second series of articles includes means for maintaining the sheet material articles of the first series of articles spaced apart from the sheet material articles of the second series of articles.

15. Sheet material handling apparatus as set forth in claim 13 further including third conveyor means for gripping sheet material articles of the first series of articles while they are conveyed by said first conveyor means and are interleaved with the second series of articles and for gripping sheet material articles of the second series of articles while they are conveyed by said second conveyor means and are interleaved with the first series of articles.

16. Sheet material handling apparatus as set forth in claim 13 wherein said first conveyor means includes means for moving articles of the first series of articles along a first path length in which articles of the first series of articles are offset to one side of articles of the second series of articles and for moving articles of the first series of articles along a second path length in which articles of the first series of articles are aligned with and interleaved with articles of the second series of articles, the articles of the first series of articles being spaced apart from the articles of the second series of articles during movement of articles of the first series of articles along the second path length.

17. Sheet material handling apparatus as set forth in claim 13 wherein said first conveyor means includes a first conveyor track along which the first series of articles are moved, said second conveyor means including a second conveyor track having a first portion which extends transversely to said first conveyor track and a second portion which extends parallel to said first conveyor track, the articles of the first and second series of articles being interleaved during movement of the second series of articles along the second portion of said second conveyor track.

18. Sheet material handling apparatus as set forth in claim 13 wherein said first portion of said second conveyor track extends along an arcuate path length.

19. An apparatus as set forth in claim 13 wherein each of said first gripper means grips an article of the first series of articles at a location having a vertical centerline offset to one side of a vertical plane through the center of the article and perpendicular to a major side of the article, each of said second gripper means grips an article of the second series of articles at a location having a vertical centerline offset to one side of a vertical plane through the center of the article and perpendicular to a major side of the article, each of said first gripper means being offset from the vertical plane through the center of the articles in a first direction when the first and second series of articles are interleaved, each of said second gripper means being offset from the vertical plane through the center of the articles in a second direction opposite to the first direction when the first and second series of articles are interleaved.

20. Sheet material handling apparatus comprising first conveyor means for conveying a first series of sheet material articles with the articles spaced apart from each other, second conveyor means for conveying a second series of sheet material articles with the articles spaced apart from each other, said first and second conveyor means including means for interleaving the first series of articles and the second series of articles with each other while the first series of articles is conveyed by said first conveyor means and the second series of articles is conveyed by said second conveyor means, said first conveyor means including means for moving articles of the first series of articles along a first path length in which articles of the first series of articles are offset to one side of articles of the second series of articles and for moving articles of the first series of articles along a second path length in which articles of the first series of articles are aligned with and interleaved with articles of the second series of articles, the articles of the first series of articles being spaced apart from the articles of the second series of articles during movement of articles of the first series of articles along the second path length.

21. Sheet material handling apparatus as set forth in claim 20 wherein said first conveyor means includes a first conveyor track along which the first series of articles are moved, said second conveyor means including a second conveyor track having a first portion which extends transversely to said first conveyor track and second portion which extends parallel to said first conveyor track, the articles of the first and second series of articles being interleaved during movement of the second series of articles along the second portion of said second conveyor track.

22. Sheet material handling apparatus as set forth in claim 21 wherein said first portion of said second conveyor track extends along an arcuate path length.

23. An apparatus as set forth in claim 20 wherein said first conveyor means includes a plurality of first gripper means each of which grips an article of the first series of articles at a location having a vertical centerline offset to one side of a vertical plane through the center of the article and perpendicular to a major side of the article, said second conveyor means includes a plurality of second gripper means each of which grips an article of the second series of articles at a location having a vertical centerline offset to one side of a vertical plane through the center of the article and perpendicular to a major side of the article, each of said first gripper means being offset from the vertical plane through the center of the articles in a first direction when the first and second series of articles are interleaved, each of said second gripper means being offset from the vertical plane through the center of the articles in a second direction opposite to the first direction when the first and second series of articles are interleaved.

24. Sheet material handling apparatus as set forth in claim 20 wherein said first conveyor means includes a first longitudinally extending track and a first plurality of grippers each of which engages an article of the first series of articles and is movable along said first track, said second conveyor means includes a second longitudinally extending track and a second plurality of grippers each of which engages an article of the second series of articles and is movable along said second track, said first and second tracks having parallel sections along which grippers of said first and second pluralities grippers move when the first series of articles is interleaved with the second series of articles, each of said grippers of said first plurality of grippers being offset along said first track from each of said grippers of said second plurality of grippers when the first series of articles is interleaved with the second series of articles.

25. Sheet material handling apparatus as set forth in claim 20 further including third conveyor means for gripping sheet material articles of the first series of articles while they are conveyed by said first conveyor means and are interleaved with the second series of articles and for gripping sheet material articles of the second series of articles while they are conveyed by said second conveyor means and are interleaved with the first series of articles.

26. Sheet material handling apparatus comprising first conveyor means for conveying a first series of sheet material articles with the articles spaced apart from each other, second conveyor means for conveying a second series of sheet material articles with the articles spaced apart from each other, said first and second conveyor means including means for interleaving the first series of articles and the second series of articles with each other while the first series of articles is conveyed by said first conveyor means and the second series of articles is conveyed by said second conveyor means, said first conveyor means including a first conveyor track along which the first series of articles are moved, said second conveyor means including a second conveyor track having a first portion which extends transversely to said first conveyor track and a second portion which extends parallel to said first conveyor track, the articles of the first and second series of articles being interleaved during movement of the second series of articles along the second portion of said second conveyor track.

27. Sheet material handling apparatus as set forth in claim 26 wherein said first portion of said second conveyor track extends along an arcuate path length.

28. Sheet material handling apparatus as set forth in claim 27 wherein said means for interleaving the first series of articles with the second series of articles includes means for maintaining the sheet material articles of the first series of articles spaced apart from the sheet material articles of the second series of articles.

29. Sheet material handling apparatus as set forth in claim 27 further including third conveyor means for gripping sheet material articles of the first series of articles while they are conveyed by said first conveyor means and are interleaved with the second series of articles and for gripping sheet material articles of the second series of articles while they are conveyed by said second conveyor means and are interleaved with the first series of articles.

30. Sheet material handling apparatus as set forth in claim 27 wherein said first conveyor means includes a plurality of first gripper means each of which grips an article of the first series of articles while the article is conveyed by said first conveyor means, said second conveyor means including a plurality of second gripper means each of which grips an article of the second series of articles while the article is conveyed by said second conveyor means, each one of the gripper means of said first gripper means being at least partially disposed between articles of the second series of articles during movement of the second series of articles along the second portion of said second conveyor track, each one of the gripper means of said second gripper means being at least partially disposed between articles of the first series of articles during movement of the second series of articles along the second portion of said second conveyor track.

31. An apparatus as set forth in claim 40 wherein said first conveyor means includes a plurality of first gripper means each of which grips an article of the first series of articles at a location having a vertical centerline offset to one side of a vertical plane through the center of the article and perpendicular to a major side of the article, said second conveyor means includes a plurality of second gripper means each of which grips an article of the second series of articles at a location having a vertical centerline offset to one side of a vertical plane through the center of the article and perpendicular to a major side of the article, each of said first gripper means being offset from the vertical plane through the center of the articles in a first direction and each of said second gripper means being offset from the vertical plane through the center of the articles in a second direction opposite to the first direction during movement of the second series of articles along the second portion of said second conveyor track.

32. Sheet material handling apparatus as set forth in claim 27 wherein said first conveyor means includes a first plurality of grippers each of which engages an article of the first series of articles and is movable along said first conveyor track, said second conveyor means including a second plurality of grippers each of which engages an article of the second series of articles and is movable along said second conveyor track, each of said grippers of said first plurality of grippers being offset along said first conveyor track from each of said grippers of said second plurality of grippers during movement of the second series of articles along the second portion of said second conveyor track.

33. Sheet material handling apparatus comprising first conveyor means for conveying a first series of sheet material articles with the articles spaced apart from each other, second conveyor means for conveying a second series of sheet material articles with the articles spaced apart from each other, said first and second conveyor means including means for interleaving the first series of articles and the second series of articles with each other while the first series of articles is conveyed by said first conveyor means and the second series of articles is conveyed by said second conveyor means, said first conveyor means including a plurality of first gripper means each of which grips an article of the first series of articles at a location having a vertical centerline offset to one side of a vertical plane through the center of the article and perpendicular to a major side of the article, said second conveyor means includes a plurality of second gripper means each of which grips an article of the second series of articles at a location having a vertical centerline offset to one side of a vertical plane through the center of the article and perpendicular to a major side of the article, each of said first gripper means being offset from the vertical plane through the center of the articles in a first direction when the first and second series of articles are interleaved, each of said second gripper means being offset from the vertical plane through the center of the articles in a second direction opposite to the first direction when the first and second series of articles are interleaved.

34. Sheet material handling apparatus as set forth in claim 33 wherein said first conveyor means includes a first longitudinally extending track, said plurality of first gripper means being movable along said first rack, said second conveyor means includes a second longitudinally extending track, said plurality of second gripper means being movable along said second track, said first and second tracks having parallel sections along which of said first and second gripper means move when the first series of articles is interleaved with the second series of articles, each of said first gripper means being offset along said first track from each of said second gripper means when the first series of articles is interleaved with the second series of articles.

35. Sheet material handling apparatus as set forth in claim 33 wherein said means for interleaving the first series of articles with the second series of articles includes means for maintaining the sheet material articles of the first series of articles spaced apart from the sheet material articles of the second series of articles.

36. Sheet material handling apparatus as set froth in claim 33 further including third conveyor means for gripping sheet material articles of the first series of articles while they are conveyed by said first conveyor means and are interleaved with the second series of articles and for gripping sheet material articles of the second series of articles while they are conveyed by said second conveyor means and are interleaved with the first series of articles.

37. Sheet material handling apparatus as set forth in claim 33 wherein each one of said first gripper means is at least partially disposed between articles of the second series of articles when the article gripped by one of said first gripper means is interleaved with articles of the second series of articles, each one of the gripper means of said second gripper means being at least partially disposed between articles of the first series of articles when the articles gripped by one of said second gripper means is interleaved with articles of said second series of articles.

38. Sheet material handling apparatus comprising first conveyor means for conveying a first series of sheet material articles with the articles spaced apart from each other, second conveyor means for conveying a second series of sheet material articles with the articles spaced apart from each other, said first and second conveyor means including means for interleaving the first series of articles and the second series of articles with each other while the first series of articles is conveyed by said first conveyor means and the second series of articles is conveyed by said second conveyor means, said first conveyor means including a first longitudinally extending track and a first plurality of grippers each of which engages an article of the first series of articles and is movable along said first track, said second conveyor means includes a second longitudinally extending track and a second plurality of grippers each of which engages ann article of the second series of articles and is movable along said second track, said first and second tracks having parallel sections along which grippers of said first and second pluralities grippers move when the first series of articles is interleaved with the second series of articles, each of said grippers of said first plurality of grippers being offset along said first track from each of said grippers of said second plurality of grippers when the first series of articles is interleaved with the second series of articles.

39. Sheet material handling apparatus as set forth in claim 38 wherein said means for interleaving the first series of articles with the second series of articles includes means for maintaining the sheet material articles of the first series of articles spaced apart from the sheet material articles of the second series of articles.

40. Sheet material handling apparatus as set forth in claim 38 further including third conveyor means for gripping sheet material articles of the first series of articles while they are conveyed by said first conveyor means and are interleaved with the second series of articles and for gripping sheet material articles of the second series of articles while they are conveyed by said second conveyor means and are interleaved with the first series of articles.

41. Sheet material handling apparatus as set forth in claim 38 wherein each one of the grippers of said first plurality of grippers is at least partially disposed between articles of the second series of articles when the article gripped by one of said first plurality of grippers is interleaved with articles of the second series of articles, each one of the grippers of said second plurality of grippers being at least partially disposed between articles of the first series of articles when the articles gripped by one of said second plurality of grippers is interleaved with articles of said second series of articles.

42. Sheet material handling apparatus as set forth in claim 38 wherein said first conveyor means includes means for moving said first plurality of grippers and articles of the first series of articles along a first path length in which articles of the first series of articles are offset to one side of articles of the second series of articles and for moving said second plurality of grippers and articles of the first series of articles along a second path length in which articles of the first series of articles are aligned with and interleaved with articles of the second series of articles, the articles of the first series of articles being spaced apart from the articles of the second series of articles during movement of articles of the first series of articles along the second path length.

43. Sheet material handling apparatus as set forth in claim 38 wherein a portion of said first track extends along an arcuate path length and a portion of said second track extends along an arcuate path length, said parallel sections of said first and second tracks beginning where said portions of said first and second tracks which extend along arcuate path lengths end.

44. An apparatus as set forth in claim 38 wherein said first plurality of grippers grip articles of the first series of articles at locations having vertical centerlines offset to one side of a vertical plane through the centers of the articles and perpendicular to major sides of the articles, said second plurality of grippers grip articles of the second series of articles at locations having vertical centerlines offset to one side of a vertical plane through the centers of the articles and perpendicular to the major sides of the articles, said first plurality of grippers being offset from the vertical plane through the centers of the articles in a first direction when the first and second series of articles are interleaved, said second plurality of grippers being offset from the vertical plane through the centers of the articles in a second direction opposite to the first direction when the first and second series of articles are interleaved.

45. A method of handling sheet material articles, said method comprising the steps of conveying a first series of sheet material articles with a first conveyor, conveying a second series of sheet material articles with a second conveyor, and interleaving the first series of articles and the second series of articles with each other while conveying the first series of articles with the first conveyor and while conveying the second series of articles with the second conveyor, said step of conveying a first series of articles with a first conveyor includes gripping each of the articles of the first series of articles with a gripper of a first plurality of grippers at a location having a vertical center line offset to one side of a vertical plane through the center of the article and perpendicular to a major side of the article, said step of conveying a second series of articles with a second conveyor including gripping each of the articles of the second series of articles with a gripper of a second plurality of grippers at a location having a vertical center line offset to one side of a vertical plane through the center of the article and perpendicular to a major side of the article, said step of interleaving the first and second series of articles including interleaving the first and second series of articles with the grippers of the first plurality of grippers offset from the center lines of the articles of the first series of articles in a direction away from the grippers of the second plurality of grippers and with the grippers of the second plurality of grippers offset from the center lines of the articles of the second series of articles in a direction away from the grippers of the first plurality of grippers.

46. A method as set forth in claim 45 further including the step of maintaining the sheet material articles of the first series of articles spaced apart from the sheet material articles of the second series of articles while performing said step of interleaving the first and second series of articles.

47. A method as set forth in claim 45 further including the steps of gripping sheet material articles of the first series of articles with a third conveyor while the articles are being conveyed by the first conveyor and are interleaved with the second series of articles and gripping sheet material articles of the second series of articles with the third conveyor while they are being conveyed by the second conveyor and are interleaved with the first series of articles.

48. Sheet material handing apparatus comprising first conveyor means for conveying a first series of sheet material articles with the articles spaced apart from each other, said first conveyor means including a first longitudinally extending track and a first plurality of grippers which move along said first track and grip sheet material articles of the first series of sheet material articles with major side surfaces of the articles extending downwardly of and transversely to a longitudinal central axis of said first track, second conveyor means for conveying a second series of sheet material articles with the articles spaced apart from each other, said second conveyor means including a second longitudinally extending track and a second plurality of grippers which move along said second track and grip sheet material articles of the second series of sheet material articles with major side surfaces of the articles of the second series of articles extending downwardly of and transversely to a longitudinal central axis of said second track, said first and second conveyor means including means for interleaving the first series of articles and the second series of articles with each other while the first series of articles is conveyed by said first conveyor means and the second series of articles is conveyed by said second conveyor means, said means for interleaving the first series of articles with the second series of articles including means for interleaving the first and second series of articles while the articles are gripped by said first and second pluralities of grippers and while major side surfaces of the articles of the first and second series of articles extend downwardly of and transversely to the longitudinal central axes of said first and second tracks.

49. Sheet material handling apparatus as set forth in claim 48 wherein said means for interleaving the first series of articles with the second series of articles includes means for maintaining the sheet material articles of the first series of articles spaced apart from the sheet material articles of the second series of articles.

50. Sheet material handling apparatus as set forth in claim 48 further including third conveyor means for gripping sheet material articles of the first series of articles while they are conveyed by said first conveyor means and are interleaved with the second series of articles with major side surfaces of the articles of the first series of articles extending downwardly of and transversely to the longitudinal central axis of said first track and for gripping sheet material articles of the second series of articles while they are conveyed by said second conveyor means and are interleaved with the first series of articles with major side surfaces of the articles of the second series of articles extending downwardly of and transversely to the longitudinal central axis of said second track.

51. Sheet material handling apparatus as set forth in claim 48 wherein each one of the grippers of said first plurality of grippers is at least partially disposed between articles of the second series of articles when the article gripped by one of said first plurality of grippers is interleaved with articles of the second series of articles, each one of the grippers of said second plurality of gripper being at least partially disposed between articles of the first series of articles when the articles gripped by one of said second plurality of grippers is interleaved with articles of said second series of articles.

52. Sheet material handling apparatus as set forth in claim 48 wherein said first conveyor means includes means for moving articles of the first series of articles along a first path length in which articles of the second series of are offset to one side of articles of the second series of articles and for moving articles of the first series of articles along a second path length in which articles of the first series of articles are aligned with and interleaved with articles of the second series of articles, the articles of the first series of articles being spaced apart from the articles of the second series of articles during movement of articles of the first series of articles along the second path length.

53. Sheet material handling apparatus as set forth in claim 48 wherein said second track has a first portion which portion which extends parallel to said first track, the articles of the first and second series of articles being interleaved during movement of the second series of articles along the second portion of said second track.

54. Sheet material handling apparatus as set forth in claim 53 wherein said first portion of said second track extends along an arcuate path length.

55. An apparatus as set forth in claim 48 wherein each gripper of said first plurality of grippers grips an article of the first series of articles at a location having a vertical centerline offset to one side of a vertical plane through the center of the article and perpendicular to a major side of the article, each gripper of said second plurality of grippers grips an article of the second series of articles at a location having a vertical centerline offset to one side of a vertical plane through the center of the article and perpendicular to a major side of the article, each gripper of said first plurality of grippers being offset from the vertical plane through the center of the articles in a first direction when the first and second series of articles are interleaved, each gripper of said second plurality of grippers being offset from the vertical plane through the center of the articles in a second direction opposite to the first direction when the first and second series of articles are interleaved.

56. Sheet material handling apparatus as set forth in claim 48 wherein said first and second tracks having parallel sections along which grippers of said first and second pluralities grippers move when the first series of articles is interleaved with the second series of articles, each of said grippers of said first plurality of grippers being offset along said first track from each of said grippers of said second plurality of grippers when the first series of articles is interleaved with the second series of articles.

57. A method of handling sheet material articles, said method comprising the steps of conveying a first series of sheet material articles with a first conveyor, said step of conveying a first series of sheet material articles including gripping upper edge portions of the first series of articles with a first plurality of grippers and moving the first plurality of grippers and first series of articles along a first track with major side surfaces of the articles extending downwardly of and transversely to a longitudinal central axis of the first track, conveying a second series of sheet material articles with a second conveyor, said step of conveying a second series of sheet material articles including gripping upper edge portions of the second series of articles with a second plurality of grippers and moving the second plurality of grippers and second series of articles along a second track with major side surfaces of the articles of the second series of articles extending downwardly of and transversely to a longitudinal central axis of the second track, and interleaving the first series of articles and the second series of articles with each other while conveying the first series of articles with the first conveyor and while conveying the second series of articles with the second conveyor, said step of interleaving the first series of articles and the second series of articles with each other being performed with the upper edge portions of the articles gripped by said first and second plurality of grippers and with major side surfaces of the articles of the first and second series of articles extending downwardly of and transversely to the longitudinal central axes of said first and second tracks.

58. A method as set forth in claim 57 further including the step of maintaining the sheet material articles of the first series of articles spaced part from the sheet material articles of the second series of articles while performing said step of interleaving the first and second series of articles.

59. A method as set forth in claim 57 further including the steps of gripping sheet material articles of the first series of articles with at third conveyor while the articles of the first series of articles are being conveyed by the first conveyor with major side surfaces of the articles extending downwardly of and transversely to the longitudinal central axis of said first rack and are interleaved with the second series of articles and gripping sheet material articles of the second series of articles with the third conveyor while the articles of the second series of articles are being conveyed by the second conveyor with major side surfaces of the articles extending downwardly of and transversely to the longitudinal central axis of said second track and are interleaved with the first series of articles.

60. A method as set forth in claim 57 wherein said step of interleaving the first and second series of articles includes interleaving the first and second series of articles with the grippers of the first plurality of grippers offset from the center lines of the articles of the first series of articles in a direction away from the grippers of the second plurality of grippers and with the grippers of the second plurality of grippers offset from center lines of the articles of the second series of articles in a direction away from the grippers of the first plurality of grippers.

* * * * *

UNITED STATES PATENT AND TRADEMARK OFFICE

CERTIFICATE OF CORRECTION

PATENT NO. : 5,007,624

DATED : April 16, 1991

INVENTOR(S) : Mohanjit S. Chandhoke

It is certified that error appears in the above-identified patent and that said Letters Patent is hereby corrected as shown below:

Column 14, Line 17, change "1" to --2--.

Column 17, Line 47, after "each" insert --one--.

Column 20, Line 52, change "40" to --27--.

Column 21, Line 49, change "rack" to --track--.

Column 25, Line 33, after "which" (1st occurrence) insert --extends transversely to said first conveyor track and a second--.

Column 26, Line 46, change "rack" to --track--.

Signed and Sealed this

Twentieth Day of October, 1992

*Attest:*

DOUGLAS B. COMER

*Attesting Officer*

*Acting Commissioner of Patents and Trademarks*